US009408440B2

(12) United States Patent
Sobbi

(10) Patent No.: US 9,408,440 B2
(45) Date of Patent: Aug. 9, 2016

(54) BELT BUCKLE WITH REMOVABLE WALLET

(71) Applicant: Bahram Sobbi, Calgary (CA)

(72) Inventor: Bahram Sobbi, Calgary (CA)

( * ) Notice: Subject to any disclaimer, the term of this patent is extended or adjusted under 35 U.S.C. 154(b) by 39 days.

(21) Appl. No.: 14/589,158

(22) Filed: Jan. 5, 2015

(65) Prior Publication Data

US 2016/0192743 A1 Jul. 7, 2016

(51) Int. Cl.
*A44B 11/00* (2006.01)
*A45C 1/06* (2006.01)

(52) U.S. Cl.
CPC ..... *A44B 11/005* (2013.01); *A45C 1/06* (2013.01)

(58) Field of Classification Search
CPC ..... A44B 11/005; A44B 11/006; A45F 5/02; A45F 5/021; Y10T 24/4098; Y10T 24/40
USPC ..... 224/163, 255, 256, 271, 272
See application file for complete search history.

(56) References Cited

U.S. PATENT DOCUMENTS

| | | | | |
|---|---|---|---|---|
| 1,625,040 | A * | 4/1927 | Marcus | A44B 11/005 224/163 |
| D220,077 | S | 3/1971 | Weingardt | |
| 4,753,377 | A | 6/1988 | Poluhowich | |
| 5,871,129 | A * | 2/1999 | Boncompagni | A44B 11/005 224/163 |
| 8,727,193 | B2 | 5/2014 | Oelzant | |
| 2007/0017999 | A1 | 1/2007 | Liu | |

* cited by examiner

*Primary Examiner* — Adam Waggenspack
(74) *Attorney, Agent, or Firm* — Maxey Law Offices; Stephen Lewellyn

(57) ABSTRACT

A belt buckle includes a buckle plate having a front side, a back side, a belt tongue, a belt pin extending outwardly from the back side, a pair of confronting dog ears extending outwardly from the front side, and a pair of spring tabs. The belt buckle further includes a wallet container having a pair of slots extending through a side end and a pair of apertures formed through a back of the wallet container. The wallet container is removably attached to the front side of the buckle plate with the spring tabs cooperatively engaged with the slots and the dog ears cooperatively engaged with the apertures.

4 Claims, 5 Drawing Sheets

BELT BUCKLE WITH REMOVABLE WALLET

FIELD OF THE INVENTION

The present invention relates generally to belt buckles, and more particularly, relating to a new belt buckle with a removable wallet.

BACKGROUND OF THE INVENTION

Belt buckles having compartments that are usable for storing valuables, such as, for example, money, driver's license, and credit cards are known. While existing belt buckles fulfill their respective, particular objectives and requirements, the need remains for an improved belt buckle with a removable wallet that can be removed without unbuckling the belt buckle.

SUMMARY OF THE INVENTION

In view of the foregoing disadvantages inherent in the known types of belt buckles including compartments now present in the prior art, the present invention provides a new belt buckle construction having a removable wallet container, which can be removed without decoupling the belt buckle from the waist belt.

In general, in one aspect, a belt buckle with removable wallet is provided. The belt buckle includes a buckle plate having a front side, a back side, a belt tongue, a belt pin extending outwardly from the back side, a pair of confronting dog ears extending outwardly from the front side, and a pair of spring tabs. The belt buckle further includes a wallet container having a pair of slots extending through a side end and a pair of apertures formed through a back of the wallet container. The wallet container is removably attached to the front side of the buckle plate with the spring tabs cooperatively engaged with the slots and the dog ears cooperatively engaged with the apertures.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
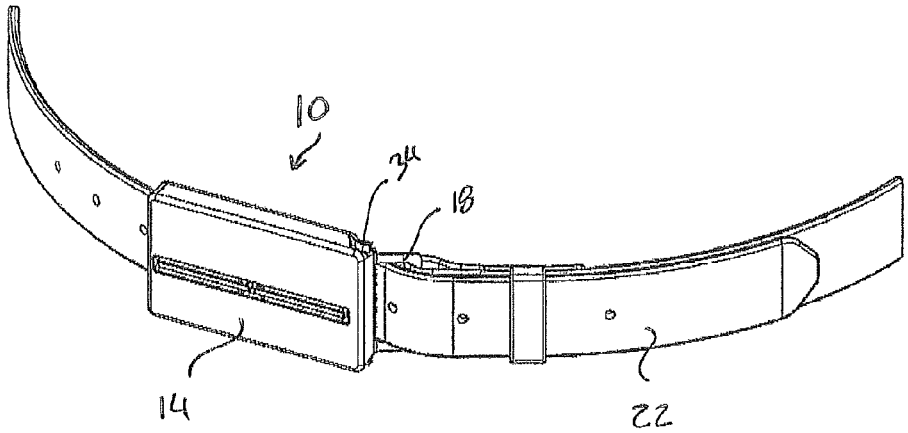
FIG. 1 is a perspective view of a belt buckle with removable wallet that is constructed accordance with the principles of an embodiment of the present invention, illustrating the belt buckle in-use with a conventional waist belt and with a wallet container attached to the belt buckle.

With reference now to the drawings, and in particular FIGS. 1 through 10 thereof, a new belt buckle with removable wallet constructed in accordance with an embodiment of the present invention and generally designated by the reference number 10 will be described.

The belt buckle 10 includes a buckle plate 12 and a wallet container 14 that is removably attached to and supported by the buckle plate. The buckle plate 12 is comprised of substantially rigid plate having front and back sides 15 and 16, respectively. And, while the buckle plate 12 is shown flat, it could be slightly curved. The buckle plate can also be made of any suitable material, such as, for example, metal or plastic.

Figure 2:
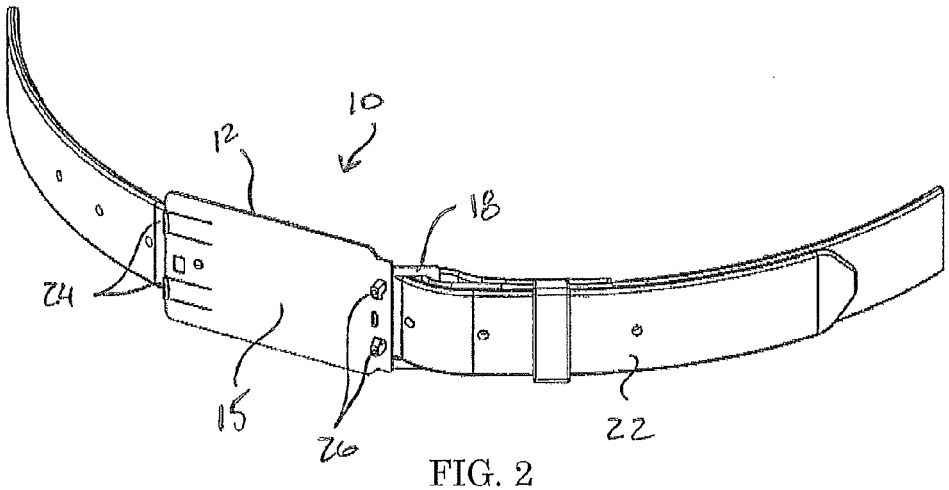
FIG. 2 is a perspective view of a belt buckle with removable wallet that is constructed accordance with the principles of an embodiment of the present invention, illustrating the belt buckle in-use with a conventional waist belt and with the wallet container removed so as to show a buckle plate.
Figure 3:
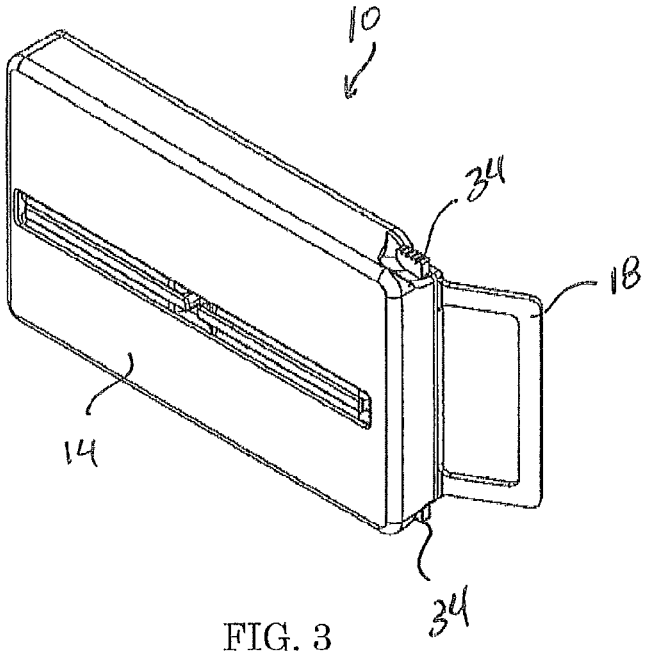
FIG. 3 is a perspective view of the belt buckle, illustrating the wallet container attached to the buckle plate and without the waist belt.
Figure 4:
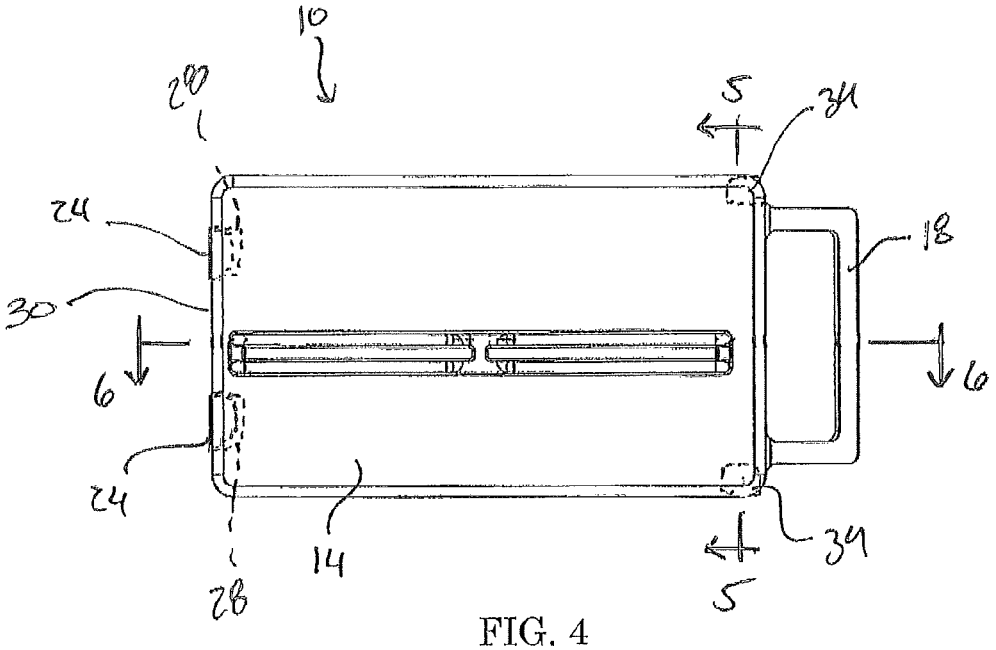
FIG. 4 is a front view of the belt buckle, illustrating the wallet container attached to the buckle plate and without the waist belt.
Figure 5:
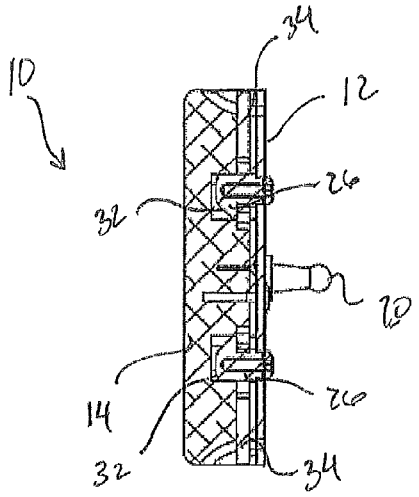
FIG. 5 is a cross-sectional view of the belt buckle taken along line 5-5 in FIG. 4, showing a cooperative engagement between the wallet container and the buckle plate.
Figure 6:
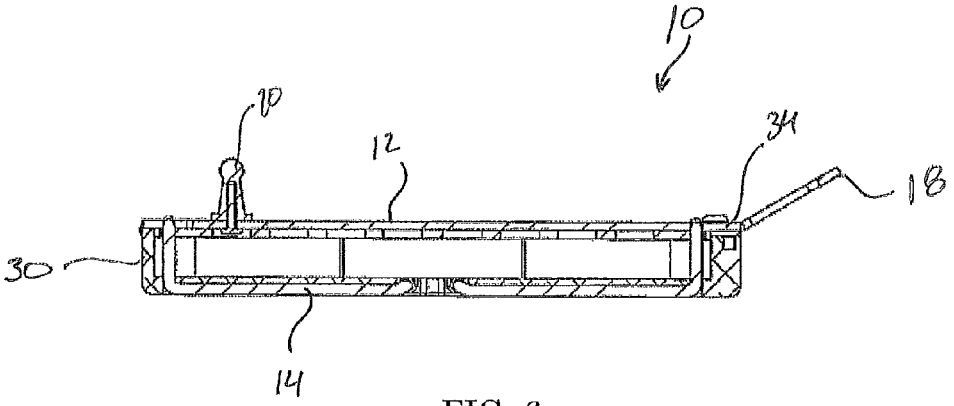
FIG. 6 is a cross-sectional view of the belt buckle taken along line 6-6 in FIG. 4, showing a cooperative engagement between the wallet container and the buckle plate.
Figure 7:
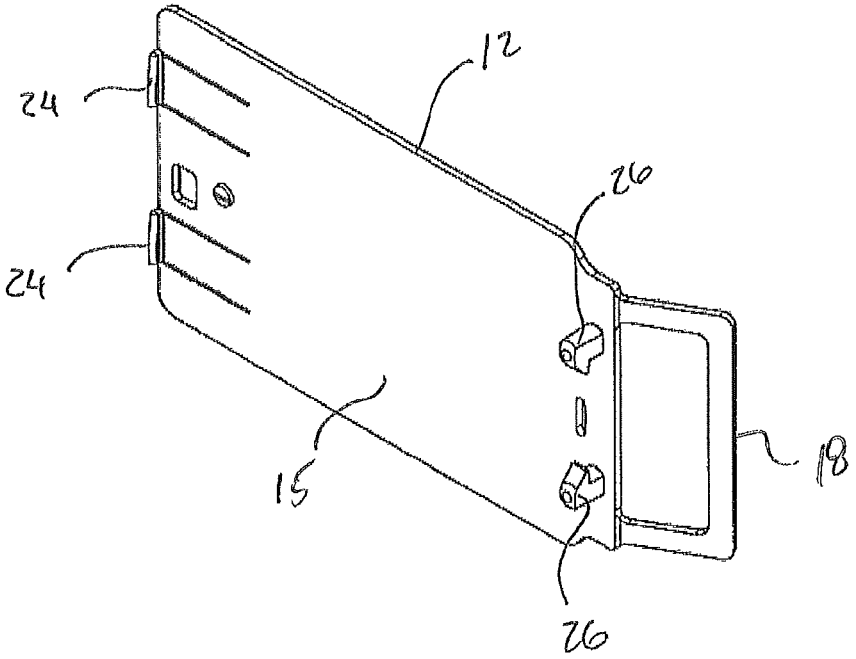
FIG. 7 is a perspective view of the buckle plate, shown with the wallet container detached.
Figure 8:
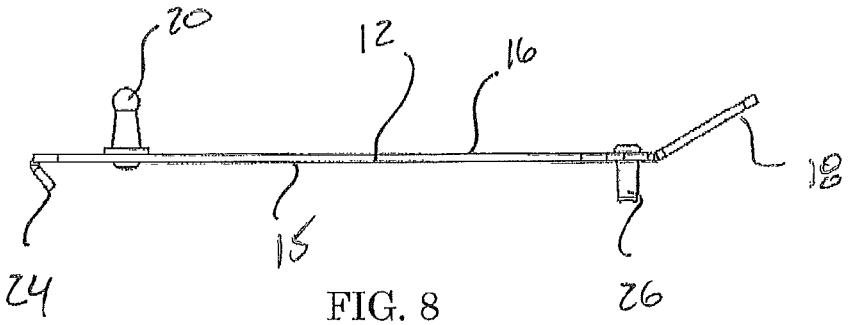
FIG. 8 is a top view of the buckle plate.
Figure 9:
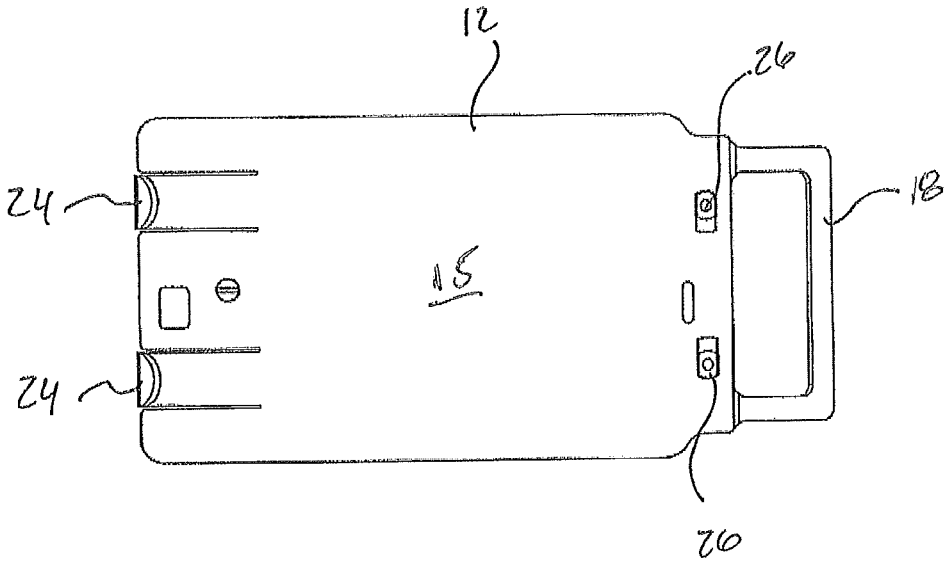
FIG. 9 is front view of the buckle plate.
Figure 10:
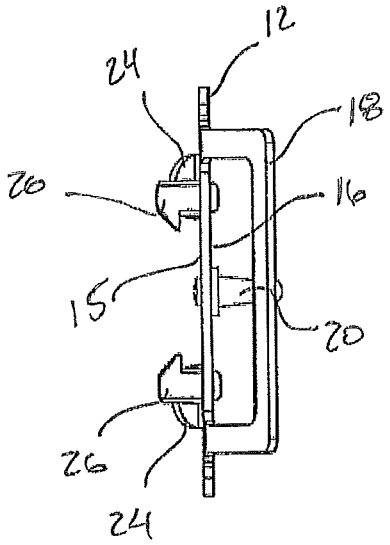
FIG. 10 is a side view of the buckle plate.

The buckle plate 12 Further includes a waist belt attachment tongue 18 and a belt pin 20 extending outwardly from the back side 16 thereof. As best seen in FIGS. 1 and 2, the buckle plate 12 is connected, for use, to a waist belt 22 in a conventional manner by looping one end of the waist belt over and through the tongue 18. The opposite end of the waist belt 22 is conventionally secured by extending belt pin 20 through anyone of the corresponding pin holes that extend along the waist belt.

Additionally, the buckle plate 12 includes a pair of spring tabs 24 at the end opposite of the tongue 18, and a pair of confronting dog ears 26 that extend outwardly from the front side 15 and approximate the tongue.

Wallet container 14 is configured to be cooperatively connected to the front side 15 of the buckle plate 12. Although the wallet container 14 is shown here as being relatively plain for the purpose of clarity, the wall container can include any desired ornamental design or shape as desired. Additionally, the wallet container 14 includes slots 28 extending through side end 30 and apertures 32 extending through the back of the wallet container. Slots 28 are arranged to cooperatively engage with spring tabs 24 and apertures 32 are arranged to cooperatively engage with dog ears 26 when the wallet container 12 is positioned on the front side of the buckle plate 12.

More specifically, the wallet container 14 is removably attached to the front side 15 of the buckle plate 12 by inserting the spring tabs 24 into corresponding slots 28 formed through side end 30 of the wallet container. And aligning and inserting dog ears 26 into corresponding apertures 32 extending through the back of the wallet container 14. Each dog ear 26 is retained in its respective aperture 32 by a catch 34 that is spring biased, and pressing inwardly on the catch 34 releases the dog ear 26 and permits withdrawing the dog ear from its respective aperture. To this end, an important aspect of the present invention is the ability to detach or remove the wallet container 14 from the buckle plate 12 without decoupling the buckle plate from the waist belt 22.

A number of embodiments of the present invention have been described. Nevertheless, it will be understood that various modifications may be made without departing from the spirit and scope of the invention. Accordingly, other embodiments are within the scope of the following claims.

What is claimed is:

1. A belt buckle with removable wallet, comprising:

a buckle plate having a front side, a back side, a belt tongue, a belt pin extending outwardly from said back side, a pair of confronting dog ears extending outwardly from said front side, and a pair of spring tabs;

a wallet container having a pair of slots extending through a side end and a pair of apertures formed through a back of said wallet container; and wherein said wallet container is removably attached to said front side of said buckle plate with said spring tabs cooperatively engaged with said slots and said dog ears cooperatively engaged with said apertures.

2. The belt buckle of claim 1, wherein said dog ears are removably retained in a respective aperture by a spring biased catch.

3. The belt buckle of claim 1, wherein said wallet container substantially overlaps said buckle plate.

4. The belt buckle of claim 1, wherein said pair of spring tabs is disposed at a side of said buckle plate opposite of said belt tongue.

* * * * *